US005785070A

United States Patent [19]

Block et al.

[11] Patent Number: 5,785,070

[45] Date of Patent: Jul. 28, 1998

[54] DUAL HANDLED WALKING AND UPRISAL ASSIST DEVICE

[75] Inventors: Randall D. Block; Darla R. Gill, both of Salt Lake City, Utah

[73] Assignee: Momentum Medical Corporation, Salt Lake City, Utah

[21] Appl. No.: 610,624

[22] Filed: Mar. 4, 1996

Related U.S. Application Data

[63] Continuation-in-part of Ser. No. 153,456, Nov. 16, 1993, Pat. No. 5,495,867.

[51] Int. Cl.[6] ..... A61H 3/00

[52] U.S. Cl. ..... 135/67; 135/84; 135/85; 135/911; 135/65

[58] Field of Search ..... 135/65, 67, 84, 135/85, 911, 912

[56] References Cited

U.S. PATENT DOCUMENTS

| | | | |
|---|---|---|---|
| 1,307,058 | 6/1919 | McGrath | 135/85 X |
| 1,400,394 | 12/1921 | Warry . | |
| 1,570,307 | 1/1926 | Kirby | 135/67 X |
| 3,289,685 | 12/1966 | Parker . | |
| 3,442,276 | 5/1969 | Edwards et al. . | |
| 3,716,067 | 2/1973 | Skoog | 135/67 |
| 4,106,521 | 8/1978 | Thomas | 135/67 |
| 4,121,605 | 10/1978 | Schmerl . | |
| 4,135,535 | 1/1979 | Thomas | 135/67 |
| 4,341,381 | 7/1982 | Norberg | 135/67 X |
| 4,342,465 | 8/1982 | Stillings | 135/67 X |
| 4,474,202 | 10/1984 | Blechner . | |
| 4,562,850 | 1/1986 | Earley et al. . | |

(List continued on next page.)

FOREIGN PATENT DOCUMENTS

| | | |
|---|---|---|
| 2587599 | of 1987 | France . |
| 3839008 | of 1990 | Germany . |
| 2136290 | of 1984 | United Kingdom . |

OTHER PUBLICATIONS

Alexander, Neil B., Albert B. Schultz, and David N. Warwick. "Rising From a Chair: Effects of Age and Functional Ability on Performance Biomechanics," *Journal of Gerontology: Medical Science*, 46:3 (1991), M91–98.

Mulley, Graham P. "Everyday Aids and Appliances," *British Medical Journal*, 296 (13 Feb. 1988), 475–476.

Rodosky, Mark W., Thomas P. Andriacchi, and Gunnar B.J. Andersson. "The Influence of Chair Height on Lower Limb Mechanics During Rising," *Journal of Orthopaedic Research*, 7:2 (1989), 266–271.

Nava, L.C. and P.A.A. Laura. "Design and Use of Improved Walking Aids," *J. Biomed. Eng.*, 7 (Oct. 1985), 329–333.

Sainsbury, R. and G.P. Mulley. "Walking sticks used by the eldery," *British Medical Journal*, 284 (12 Jun. 1982), 1751.

*Primary Examiner*—Wynn E. Wood
*Attorney, Agent, or Firm*—Trask, Britt & Rossa

[57] ABSTRACT

A dual handled walking-assist and uprisal-assist device is disclosed having the handles spaced at a predetermined distance to provide a stable structure for rising from and lowering to a seated position, in addition to serving as a walking aid. The walking- and uprisal-assist device has a structure having a first handle or first pair of handles which are useful whenever a user is in a standing position. A second handle or second pair of handles are spaced a preselected distance from the first handle or handles and at a preselected distance from the bottom of the device. An infirmed user can use the second handle or handles as a grip to push against when the user is rising from a chair. The second handle or handles are connected to one or more load-bearing shafts and the geometrical centers of the handles are positioned relative to the load-bearing shafts to provide a stable structure when used for uprisal and walking. The load-bearing shaft or shafts of the device may be configured with height adjustment means to selectively determine the overall height of the device. The walking- and uprisal-assist device of the present invention may be manifest in either a cane or a walker.

38 Claims, 12 Drawing Sheets

U.S. PATENT DOCUMENTS

| | | | |
|---|---|---|---|
| 4,583,080 | 4/1986 | DiVito et al. . | |
| 4,625,742 | 12/1986 | Phillips . | |
| 4,941,495 | 7/1990 | Boyce et al. . | |
| 4,941,496 | 7/1990 | Berning . | |
| 4,962,781 | 10/1990 | Kanbar | 135/85 X |
| 4,993,446 | 2/1991 | Yarbrough | 135/67 |
| 5,005,599 | 4/1991 | Cunningham . | |
| 5,156,176 | 10/1992 | Doorenbos | 135/85 X |
| 5,347,666 | 9/1994 | Kippes . | |
| 5,445,174 | 8/1995 | Cunningham . | |
| 5,465,744 | 11/1995 | Browning | 135/67 |

DUAL HANDLED WALKING AND UPRISAL ASSIST DEVICE

RELATED APPLICATION

This is a continuation in part of Ser. No. 08/153,456, filed Nov. 16, 1993, now issued as U.S. Pat. No. 5,495,867.

BACKGROUND OF THE INVENTION

1. Field of the Invention

The instant invention relates to walking assist devices having auxiliary handles to assist a seated person in rising to a standing position.

2. State of the Art

Various types of devices have been employed to assist people who are recovering from various types of injuries and surgery, or who are experiencing weakness or instability from conditions associated with advanced age or other causes, in moving from a seated position to a standing position. Complicated and expensive devices such as tilting chairs and the like have been developed for such purposes. Also, various types of four legged walkers and devices designed to be supported by a chair or bed have been used for this purpose.

Although the problem has existed from time immemorial, it still receives considerable attention from the medical community and numerous articles have been recently written. Exemplary articles of this type include the following:

"Rising from a Chair: Effects of Age and Functional Ability on Performance Biomechanics," *Journal of Gerontology: Medical Sciences*, v. 46, n. 3 (1991), M91–98 by Alexander, Schultz and Warwick.

"Walking Stick Used by the Elderly," *British Medical Journal*, v. 284, p. 1751, 12 Jun. 1992, Sainsbury & Meiliey.

"Everyday Aids & Appliances—Walking Sticks," *British Medical Journal*, v. 296, 13 Feb. 1988, Mulley.

"The Influence of Chair Height on Lower Limb Mechanics During Rising," *Journal of Orthopaedic Research* (1989), 7:266–271.

"Design and Use of Improved Walking Aids," *J. Biomed Eng.*, v. 7, Oct. 1985, Nava and Laura.

These articles discuss several matters including the desirability of arm rests on chairs in assisting uprisal in preference to greater chair height, the desirability of correctly sizing the height of a walking stick and the necessity of walking sticks for a significant portion of the population over age 75. Also, a retractable crutch which can have its shoulder support lowered to assist a person during seating from a standing position is discussed. This crutch, discussed in the last cited article, has a spring which compresses to provide a "stored" force to raise the shoulder piece to a fully extended height upon spring release prior to uprisal.

Developers in the field have given attention to the problem and various cane or cane-like devices are disclosed in a number of patent or patent-related documents. British patent application No. GB2136290A of Walker, U.S. Pat. No. 3,289,685 of Parker, and U.S. Pat. No. 4,562,850 to Early et al. disclose devices with a plurality of handles and a cane-like structure. Also, U.S. Pat. No. 1,400,394 to Warry discloses a telescoping crutch-like device with a single shaft wherein an auxiliary handle may be gripped when the crutch is fully extended so that its top support fits under the arm of an individual.

The device of Walker has four handles at the top of the device wherein the lower handles may be gripped by a person seated for the purpose of pulling on the handles with the device in a frontal position to attempt to pull oneself into a standing condition. The upper and lower handles of the Walker device are located close to one another and the device is such that it has two pair of handles located at two different levels of the cane. The device of Parker has two handles, but the handles are not located with their geometric centers above the shaft member. The principal use of the two handles of the Parker cane is for stability when a user is traversing uneven terrain, although the patent mentions its use for uprisal purposes. The upper and lower handles of Parker are relatively close together, e.g., about six inches. Thus, as one attempts to use these canes, the pressure of the handles will cause some rotational force upon the wrist of the user when trying to rise from a seated position and since many users have arthritic conditions, torque on the wrist is generally to be avoided. Furthermore, the handles of the Parker device are sufficiently close together that one using such a cane, especially alongside a chair, would experience an uncomfortable position for the wrist, hand, and forearm because of the limited space available between the handles. Again, as with the Walker device, the more comfortable and biomechanically advantageous position in which to use a cane for uprisal purposes is alongside a chair and close to one's center of gravity when seated. The close proximity of the two handles of Parker does not really permit this type of convenient use of the device so one can push down upon a lower handle rather than trying to pull oneself into an erect position.

The device of Early has a collar close to the handle of the cane wherein the collar provides a small surface for a person to try to pull on in order to pull oneself into a standing position. The collar is too close to the handle to be used in a pushing-down motion and again it appears that this is a cane structured toward use in front of a seated user.

Another patent disclosing a supplementary handle is U.S. Pat. No. 4,121,605 to Schmerl which has a rather long stabilizing bar which is pivoted in close proximity to the cane handle wherein the bar may be rotated to a substantially perpendicular position with respect to the cane shaft wherein a second hand may be comfortably placed along the stabilizing bar when a user of the cane has his or her other hand on the cane handle and is apparently in a standing position. This bar is also located close to the main cane handle so that it would not be useful in assisting a person rising from a chair unless that user were trying to pull on the stabilizing bar.

Other structures, such as that illustrated in U.S. Pat. 4,941,495 of Boyce et al. have also been developed to provide uprisal aid. This device has a pair of "arm rests," which are laterally spaced a sufficient distance to encompass the hips of a user. These "arm rests" provide hand support for a person rising from a seated to a standing position.

In addition to the development of canes as walking assist devices and uprisal assist devices, other walking assist devices have been developed with multiple leg members to provide stabilized support for the user during walking. Such devices include walkers which typically have four spaced apart legs, as disclosed in U.S. Pat. No. 3,442,276 to Edwards, et al. The user advances the walker ahead of himself or herself the distance of an arm length, and then leans upon the walker as he or she walks forward toward the walker. Walker devices have been disclosed in the patent literature which not only attempt to provide a stable walking-assist means, but to provide some assistance in uprisal from a sitting position.

U.S. Pat. No. 4,474,202 to Blechner discloses a walker having two spaced apart foot rests upon which the user places his or her feet while grasping a forward bar to pull himself or herself up to a standing position. The Blechner device has the disadvantage of being unstable as well as difficult and awkward to use. The Blechner device is also unsafe as the user pulls on the front of the device to rise. Noting that disadvantage, U.S. Pat. No. 5,347,666 to Kippes discloses an uprisal device having extended horizontal rods at ground level to counterbalance the user's forceful pull on a front bar of the device. The Kippes device, however, also discloses the need for having a second person, in a standing position, to serve as an anchor on the front part of the device to aid the user in uprisal. Further, the Kippes structure serves only as an uprisal device, not as a walking-assist device.

U.S. Pat. No. 5,005,599 and U.S. Pat. No. 5,445,174, both to Cunningham, disclose walker devices which have attached, articulating brace members which swing outwardly from the walker frame to be positionable over a chair or other seating structure. The extended braces are intended to be grasped by the user to assist in rising from a seated position, but such devices are inherently unstable since the vertical line of downward force applied by the user when rising from a seated positioned causes the walker to rotate or collapse backwards on the user because the braces are positioned behind the walker (i.e., in the direction of the user). Such devices are not only unstable for uprisal, but are unstable for assisting the user in sitting because of the configuration of the device. The Cunningham devices also require a stable surface upon which to place the braces during uprisal which may not always be available (e.g., when seated on a sofa or soft lounge chair). Therefore, such devices cannot be classified as self-contained uprisal-assist devices.

U.S. Pat. No. 4,941,496 to Berning discloses a walking assist device having two legs and two sets of spaced apart grips to assist the user in rising from a seated position or in climbing stairs. The two vertically spaced grips of the Berning device are spaced so closely together, however, that the device cannot be used effectively as an uprisal-assist device. In addition, the Berning device is inherently unstable because of its substantially elongated vertical profile.

The walking assist devices previously described provide varying proficiency in assisting a person wishing to rise from a seated position, but each has certain disadvantages relating principally to the instability of the device. For example, none of the walker devices previously described are designed to also assist a user in sitting down (that is, without the aid of another person anchoring the front of the device to counterbalance the user's force). By their designs, the support handles intended for assisting the user in uprisal are positioned behind the walker, and a downward force of the user on the support handles thereby causes the walker to rotate onto the user. Thus, it would be advantageous to provide a combined walking-assist and uprisal-assist device which is inherently stable and configured to assist a user in both rising from a seated position and lowering himself or herself to a seated position.

SUMMARY OF THE INVENTION

In accordance with the present invention, a walking- and uprisal-assist structure is provided which is both ergonomically and biomechanically structured to provide a user with one or more pairs of vertically-spaced supportive handles, the upper handle being positioned to support a user when in a standing position and the lower handle being positioned sufficiently low so that a user can place the walking- and uprisal assist device along side himself or herself while in a seated position and push down on the lower handle or handles to assist in rising to a standing position. The lower handle is spaced a sufficient distance from the upper handle to avoid blocking the lower portion of the user's forearm when the user is gripping the lower handle in uprisal and to prevent the upper handle from obstructing the user's upper arm or body while rising from, or lowering to, a seated position. The lower handle is located such that its geometric center is positioned relative to a load-bearing axis formed through a ground-engaging point of the device to assure stability of the walking- and uprisal-assist device as the user applies force to the lower handle or lower handles when rising from or lowering to a seated position. The present invention disclosed herein may be in the form of either a cane having a single load-bearing shaft or a walker having three or more stabilizing and load-bearing legs.

The cane embodiment of the instant invention is preferably a single continuous structural member which forms an upper handle and a lower handle with a curved web connecting the two handles, and which connects the lower handle by a gooseneck curve to the load-bearing shaft of the cane. The load-bearing shaft may terminate at its bottom or distal end with a ground-engaging tip or surface. The shaft may be hollow to receive a telescoping cane extension member which may be adjusted to provide a cane having a selectable length dimension.

One particular embodiment of the cane of the instant invention is one in which an upper handle is substantially parallel to a lower handle and is connected by a web member which is preferably cylindrical or tubular in cross section and which is integral with the handles. The lower handle is connected to the main load-bearing shaft by a gooseneck curve with the whole structure being an integral one-piece structure. The presence of these multiple curved portions provides certain shock absorbing characteristics to the cane. The cane is unique in having multiple curved sections which, in certain configurations, are pleasingly attractive. Also, shock absorbing characteristics are provided by many of these unique canes, which is quite desirable for persons having arthritic wrists, elbows, and shoulders.

The height of an average chair seat is about 16 to 17 inches from the floor. The cane of the instant invention is designed and structured preferably to have a lower handle which is substantially geometrically centered over the load-bearing shaft and which is located on the cane at a height above the ground-engaging tip of the cane which is generally only slightly higher than the height of an average chair seat from the floor. Thus, the distance between the second handle and the ground-engaging tip of the cane is generally from about 16 to 25 inches, depending on the height of the user of the cane, and is preferably about 17 inches to about 24 inches. A telescoping extension member positioned near the tip of the cane can generally provide about 6 to 8 inches of adjustment in height so that a single cane may provide a selection of distances between the second handle and the ground-engaging tip of the cane to accommodate a wide variety of heights among individuals.

The first handle, or top handle, is preferably at least about nine inches above the lower handle and is generally from about 10 inches to about 16 inches above the lower handle. A minimum distance of about 9 inches between the top handle and the lower handle is desirable so that when a user is in a seated position and is grasping the lower handle for uprisal purposes, the upper handle does not block the forearm and cause the user to have a bent wrist when trying to push himself or herself up from a seated position.

Generally it is preferred that the cane of the present invention be structured as a unitary and continuous structure, having curvilinear portions associated with the handles, such that the geometric centers of both handles are substantially positioned relative to the load bearing shaft of the cane to provide an advantageous degree of stability and shock absorbency to the cane when weight is applied by the user. Alternative structures, however, are quite useful. For example, the cane may be made wherein the top handle and the main cane body are one structural element wherein there is a compound curve joining a relatively long straight upper portion and a straight load-bearing shaft (lower portion) and an adjustable handle attached to the straight upper portion so that varying distances can be attained between the top handle and the lower handle on the same cane.

In such a structure, it is useful, of course, to employ a telescoping shaft extension member or other adjustment means so that the overall height of the cane can be adjusted to fit varying heights of individuals to ensure that the top handle is at a comfortable location when a user of the cane is in a standing position. In such a structure, it is again preferred that the handles be positioned so that each is geometrically centered in alignment with the load-bearing shaft of the cane, or in substantial alignment with the ground-bearing tip.

The walking- and uprisal-assist device of the present invention may also be embodied as a walker having at least three, and preferably four, stabilizing and load-bearing legs which assist in ambulatory movement of the user. The walker device of the present invention is generally structured with a frame having opposing side portions, each side portion having a first or upper handle vertically spaced from a second or lower handle. The second or lower handle of each side portion is positioned at a height relative to a ground-engaging surface or tip to be conveniently grasped by a user when in a seated position. A downward force by the user on the lower handle of each side portion assists in raising the person to a standing position, at which time the user may reposition his or her hands on the first or top handle of each side portion. The lower handles are also conveniently and comfortably positioned to assist the user in lowering himself or herself to a seated position while maintaining stability in the walker device.

The first handle and second handle of each side portion are spaced apart in vertical orientation to allow grasping of the second or lower handle without impedance by the first or top handle. Thus, the wrist of the user is not adversely positioned, strained or twisted during the action of rising from a seated position or lowering to a seated position. Further, the geometrical center of the second handle of each side portion is positioned in front of the longitudinal axis formed through the ground-engaging surface associated with the rear, load-bearing leg to which each second handle is respectively attached. By its construction, downward force applied by the user on each second handle causes the applied weight to be stably distributed to the three or more load-bearing legs, thereby stabilizing the whole walker as the user rises from or lowers to a seated position. By contrast, prior art walkers which position a handle to the rear or behind the rear legs create an unstablizing moment when downward force is applied to the handles and the walker tends to rotate or collapse upon the user. In the walker of the present invention, the geometric center of the second handle of each side portion may be positioned anywhere from just in front of the longitudinal axis formed through the rear ground-engaging surface to about the center vertical axis formed through each side portion.

The walker may also be configured with height adjustment means in the legs to selectively adjust the height of the walker to accommodate persons of varying height. Selective adjustment in the legs also provides adjustment of the distance between the second handle of each side portion relative to the ground-engaging surface of the rear leg associated with each second handle, respectively. Adjustment means may also be provided between the first handle and the second handle of each side portion to selectively adjust the distance between the first and second handle, again to accommodate the variation in height among various users. The walker of the present invention may also be configured with means for collapsing the walker to a profile which makes it easier to store or carry when not in use. In addition, the walker may be constructed with a movable seat member which may be brought into engagement with the legs of the walker to provide a seat upon which the user may rest. The seat may then be disengaged from the legs to permit the walker to be folded into a two-dimensional profile. The seat, when engaged with the legs, is positioned slightly below the level of the second handle of each side portion to permit the user to conveniently grasp the second handles for uprisal from the seat.

DETAILED DESCRIPTION OF THE ILLUSTRATED EMBODIMENTS

The instant invention provides a walking- and uprisal-assist structure which has a number of advantages.

Generally, it is light weight and has at least one pair of handles which are vertically spaced a predetermined distance apart. The handles have geometrical centers which are positioned relative to a longitudinal axis associated with a load-bearing shaft of the walking- and uprisal-assist device so that the walking- and uprisal-assist device is stably supportive when used to rise from or lower to a seated position. The upper and lower handles of each pair are spaced sufficiently far apart so that the hand, wrist and forearm are generally in a comfortable position between the handles while one hand grips the lower handle for uprisal purposes. The device is also configured so that the position of the upper handle does not interfere with use of the lower handle. The lower handle is at a predetermined distance from the ground engaging surface or tip of the walking- and uprisal-assist device so that when in a vertical position, the lower handle is comfortably located for a seated user to grasp and to push down on so that the user can raise himself or herself from a seated position, or to lower himself or herself to a seated position.

Figure 1:
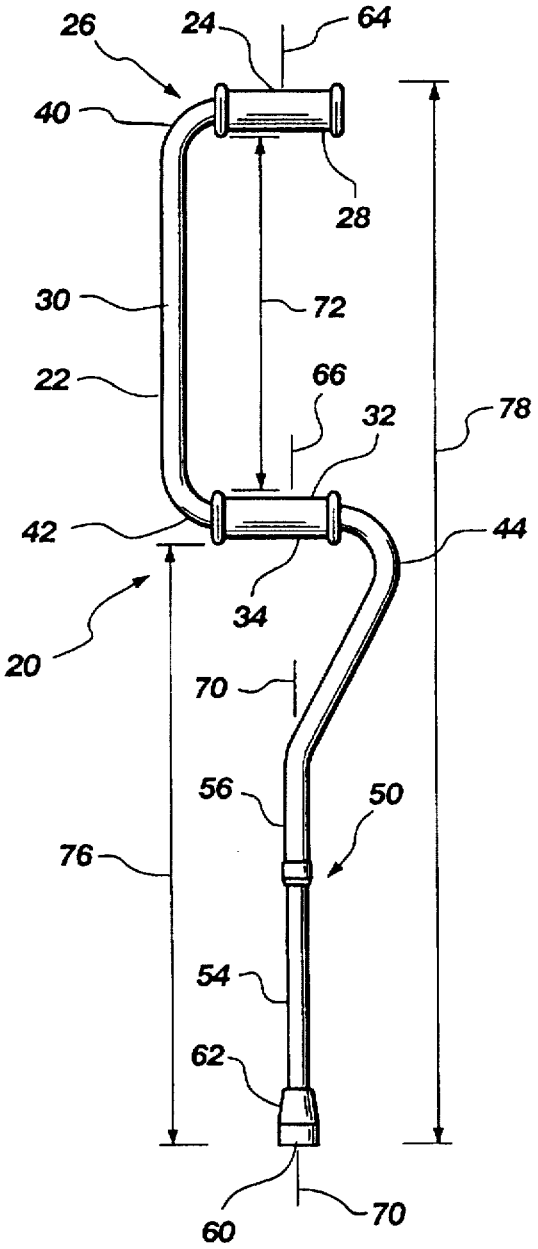
FIG. 1 is an elevational view of a two-handled cane of the instant invention.

A preferred embodiment of the instant invention formed as a cane is illustrated in FIG. 1. The cane 20 is composed of a continuous member 22 having a first handle 24 positioned at the top 26 of the cane 20. The first handle 24 may have a soft covering 28 which makes gripping the first handle 24 more comfortable. A web member 30 interconnects the first handle 24 to a second handle 32, which may also have a soft, durable covering 34 making the second handle 32 more comfortable to grasp. The web member 30 is joined to the first handle 24 by curved portion 40 and to the second handle 32 by curved portion 42. A gooseneck curved portion 44 connects second handle 32 to a load-bearing shaft 50 and geometrically positions both the first handle 24 and the second handle 32 relative to the load-bearing shaft 50 to appropriately distribute weight imposed upon the cane 20 by the user. An adjustable shaft extension 54 slidingly telescopes within a tubular section 56 of the load-bearing shaft 50. At the bottom 60 of the cane 20 is located a ground-engaging surface 62 or tip which may preferably be a rubber friction tip.

As illustrated in FIG. 1, first handle 24 and second handle 32 are located directly above, and in line with, the load-bearing shaft 50 so that when the cane is in a substantially vertical position, the force of a user's hand on either the first handle 24 or the second handle 32 is directly translated into the load-bearing shaft 50 through the adjustable shaft extension 54 and to the ground-engaging surface 62. Preferably, the geometric center 64 of the first handle 24 and the geometric center 66 of the second handle 32 are directly positioned over the longitudinal axis 70 of the load-bearing shaft 50 which is also formed through the ground-engaging surface 62.

Although for functional purposes the shape of the cane 20 illustrated in FIG. 1 could be altered to provide, for example, a multiplicity of curved joints, curved sections 40, 42, and 44 principally provide a degree of shock absorbing character to the cane 20. The radius of curvature of the curved portions 40, 42 and 44 is generally from about one to four inches, and preferably from about two to three inches. First handle 24 and second handle 32 could, of course, be directly butted against web member 30 in a perpendicular fashion and welded to web member 30 so that curved sections 40 and 42 are eliminated. Some resiliency and aesthetics may be lost by such a structure, but certain other advantages may accrue. For example, if web member 30 is made into two sections wherein one section telescopes into the other (see FIG. 4), then having a long straight web member 30 without any curved ends could be advantageous. Also, gooseneck curved portion 44 could be a tight U-turn with a substantially 90° curve connecting the gooseneck curve portion 44 to load-bearing shaft 50.

In the cane 20 of the instant invention, it is generally desired to have a distance 72 of about nine inches minimum between first handle 24 and second handle 32. A preferred distance 72 is about 10 inches to a maximum of about 16 inches. For general use, three sized models may be made which will satisfy the needs of people of widely varying heights. A smaller model having a distance 72 of ten inches, plus or minus one inch; a middle model having a distance 72 of thirteen inches, plus or minus one inch; and a model for taller people having a distance 72 of sixteen inches, plus or minus one inch.

The distance 76 from the second handle 32 to the bottom 60 of the ground-engaging surface 62 may generally be from about 17 to 25 inches, and preferably from about 19 to about 24 inches, with an optimum distance of 22 inch height 78 for the cane 20 may generally be from about 29 to about 42 inches. If the distance 72 between the first handle 24 and the second handle 32 is about 16 inches, then the distance 76 from the second handle 32 to the bottom 60 of the cane 20 would be generally about twenty-four inches to achieve an overall height 78 of about forty inches. Such a cane would generally be intended for a person over six feet tall and would accommodate people of over six feet six inches in height.

In models having a distance 72 between the first handle 24 and the second handle 32 of about ten inches, a preferred distance 76 between the second handle 32 and the bottom 60 of the cane 20 would be about nineteen inches to achieve an overall height 78 of about twenty-nine inches. Such a cane 20 would accommodate people of a height of about five feet. A model having a distance 72 between the first handle 24 and the second handle 32 of about thirteen inches generally has a distance 76 between the second handle 34 and the bottom 60 of the cane 20 of about twenty-two inches. That height would accommodate people of a height in the mid-five feet to six feet range.

Generally, the cane 20 of the present invention is made with a telescoping load-bearing shaft 50 of a type which is currently in use with aluminum canes to provide selected height adjustment of up to several inches. Thus, the overall height 78 of any cane 20 may range between about twenty-nine inches and about forty inches within three cane models. By having a sharp U-bend instead of gooseneck curve portion 44, a longer load-bearing shaft 50 may be achievable so that adjustable shaft extension 54 may have a longer run of travel within tubular section 56 which could result in more adjustability of overall height 78 and adjustability of distance 76 between the second handle 32 and the bottom 60 of the ground-engaging surface 62.

The shaft diameter of the cane 20 of the instant invention is generally from about three-fourths to about one inch plus or minus one-quarter inch. Aluminum tubular canes generally have an outer diameter of about seven-eighths inch. The cane 20 may be made out of wood, tubular aluminum, tubular steel or a solid, composite material such as a fiberglass reinforced resin or carbon fiber composite. Tubular aluminum material is generally preferred because of its availability, its formability, its strength and its lightness of weight. A carbon fiber composite cane 20 would be very strong and light-weight and could be readily formed. Generally, a carbon fiber composite cane 20 would be much stronger than aluminum and would have great flexural strength. For example, if the cane 20 were sat upon and bent, the cane 20 would return to its original position, while a tubular aluminum cane 20 under similar circumstances might be bent to a point that the aluminum would be creased and the bend would be permanent unless the cane 20 were re-straightened. The shock absorbing characteristics of the cane 20 are maintained regardless of materials of construction provided that the curved sections are engineered to have some flexural characteristics.

Figure 2:
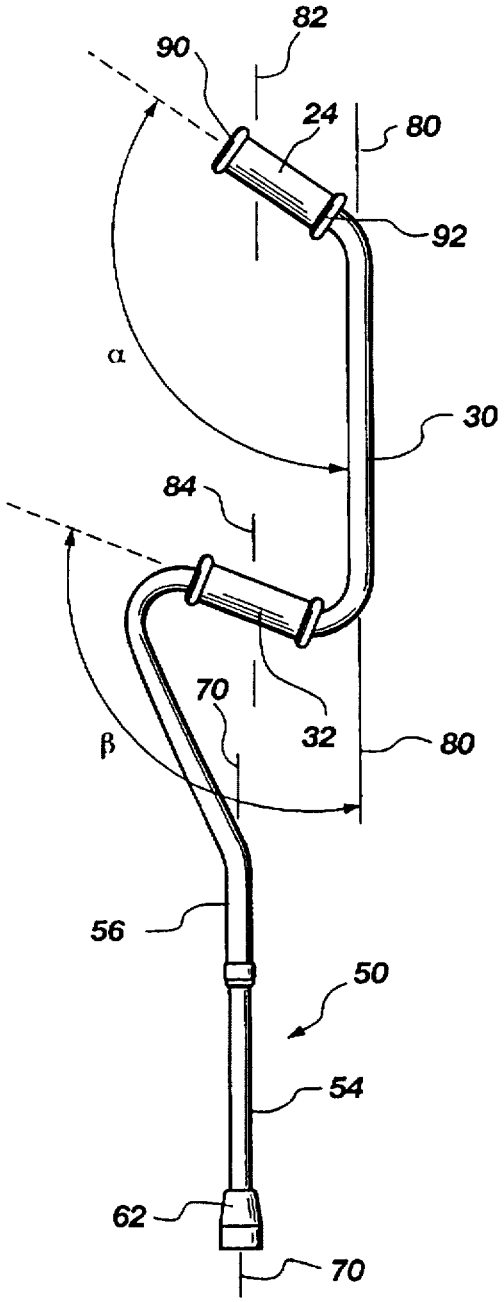
FIG. 2 is an elevational view of a two-handled cane similar to FIG. 1 with inclined handles.

Other configurations may be adopted in the cane 20 of the present invention. As shown in FIG. 2, for example, the first handle 24 and the second handle 32 may be inclined at an angle of greater than 90° with respect to a longitudinal axis 80 formed through the web member 30. The angle alpha respecting first handle 24 may be from about 90° to about 135° with respect to the longitudinal axis 80. The angle beta respecting the second handle 32 may also be from about 90° to about 135° with respect to the longitudinal axis 80. Notably, the first handle 24 and second handle 32, though inclined relative to the web member 30 or load-bearing shaft 50, are still positioned so that the center of gravity 82 of the first handle 24 and the center of gravity 84 of the second handle 32 are substantially aligned with the longitudinal axis 70 formed through the load-bearing shaft 50.

In the embodiment of the invention illustrated in FIG. 2, the first handle 24 and second handle 32 may be declined as well as inclined, or one handle may be declined while the other is inclined. For the purposes of this application, it is considered that the first handle 24 and second handle 32 are illustrated as being inclined because, for example, the free end 90 of the first handle 24 is higher than its other end 92. First handle 24 could be declined so that the free end 90 is lower than the other end 92 of the first handle 24. The second handle 32 may remain inclined as shown in FIG. 2 or may be declined similar to first handle 24. The first handle 24 and second handle 32 may be declined in parallel orientation to each other, or may not be parallel. The cane 20 illustrated in FIG. 2 may be used with the heel of the hand positioned near the free end 90 of first handle 24 or with the heel of the hand at the other end 92 of the first handle 24. The same may be true with respect to the second handle 32 and the relative positioning of the heel of the user's hand with respect thereto.

Figure 3:
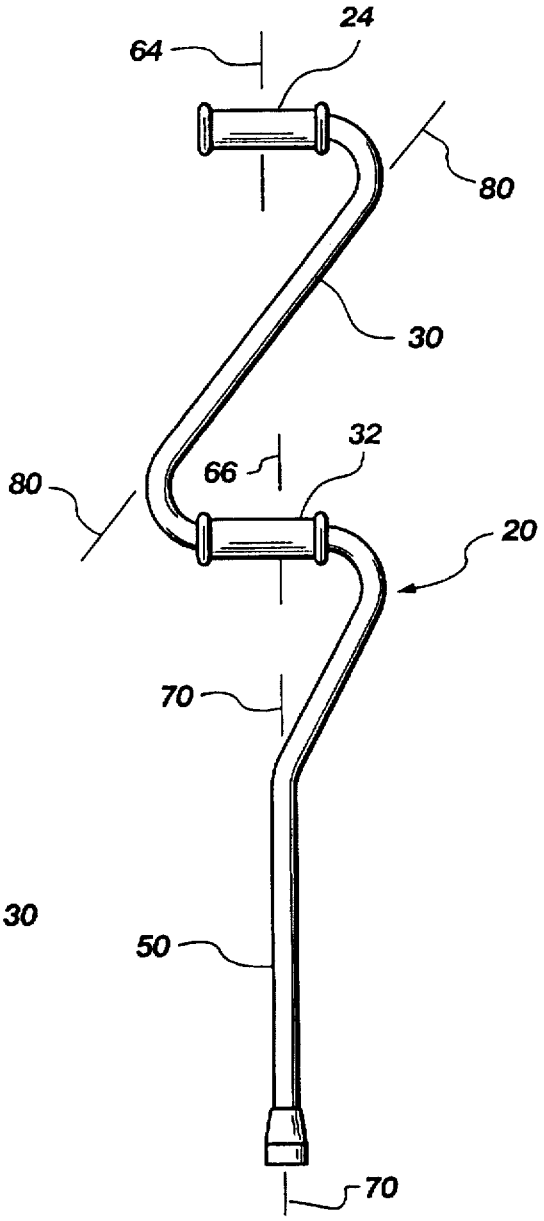
FIG. 3 is an elevational view of a two-handled cane having a Z-shaped tubular web member connecting the two handles.

An alternative embodiment of the cane 20 of the present invention is illustrated in FIG. 3 where the web member 30 is formed at an angle to the longitudinal axis 70 formed through the load-bearing shaft 50 to form a Z-shaped configuration between the first handle 24 and the second handle 32 in the upper portion of the cane 20. First handle 24 and second handle 32, which are shown as having a substantially horizontal aspect when the cane 20 is in a vertical position, are interconnected by the web member 30. Because web member 30 has curved sections 40, 42 which are curved at an angle less than 90° relative to the longitudinal axis 80 formed through the web 30, the cane 20 illustrated in FIG. 3 may have greater shock absorbing characteristics than the cane embodiments illustrated in FIGS. 1 and 2.

Figure 4:
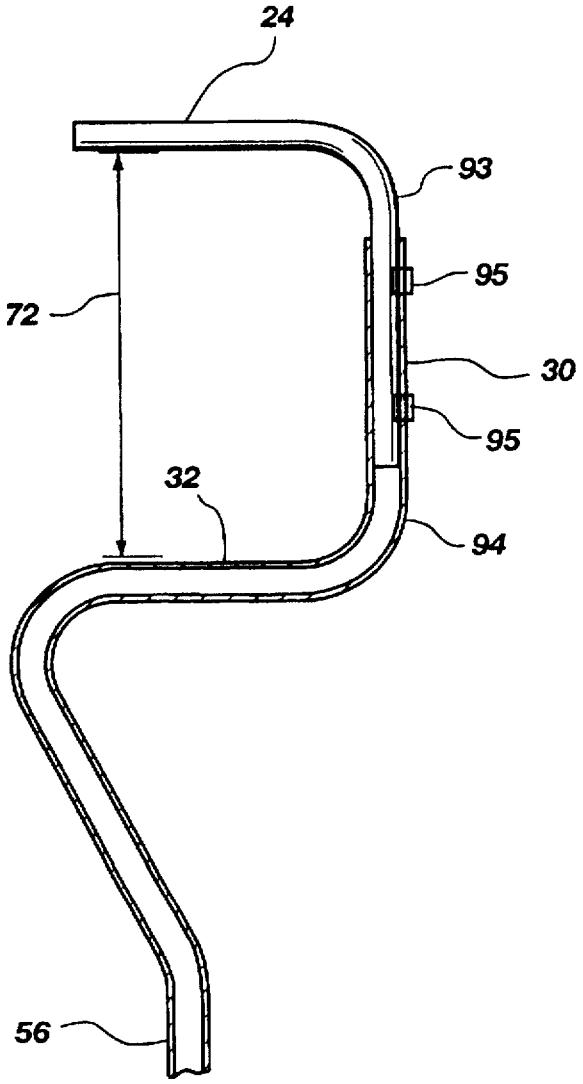
FIG. 4 is a partial view in elevation of an adjustable web member for providing adjustable spacing between the handles.

As illustrated in FIG. 4, the web member 30 may be configured with a first telescoping member 93 which is sized to be slidingly received in a second telescoping member 94. The first handle 24 is formed to the first telescoping member 93 and the second handle 32 is formed to the second telescoping member 94. Thus, first handle 24 may be adjusted upwardly or downwardly with respect to the second handle 32 to give greater comfort and to accommodate users of varying height. Notably, the embodiment of FIG. 4 effectively eliminates the need for manufacturing different model sizes to accommodate varying heights. The distance 72 between the first handle 24 and the second handle 32 may be adjusted from a minimum of about ten inches to a maximum of about sixteen inches. The first telescoping member 93 and second telescoping member 94 may be interlocked and adjustable by such means as a detent 95 mechanism or other suitable means.

Figure 5:
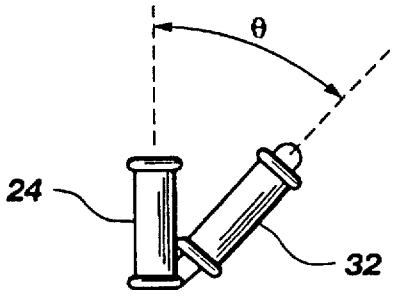
FIG. 5 is a plan view of the embodiment shown in FIG. 4 (with handle covers added) illustrating the horizontal adjustability of the first handle relative to the second handle.

The first telescoping member 93 may be made so that it rotates with respect to the second telescoping member 94 so that the first handle 24 can be rotated horizontally when the cane 20 is in an upright position to move the first handle 24 to a comfortable position. As illustrated in FIG. 5, the second handle 32 and load-bearing shaft may be aligned in a single vertical plane, and by horizontal rotation of the first handle 24 relative to the second handle 32, the first handle 24 can be positioned in another vertical plane oriented at an angle θ to the vertical plane of the second handle 32.

Figure 6:
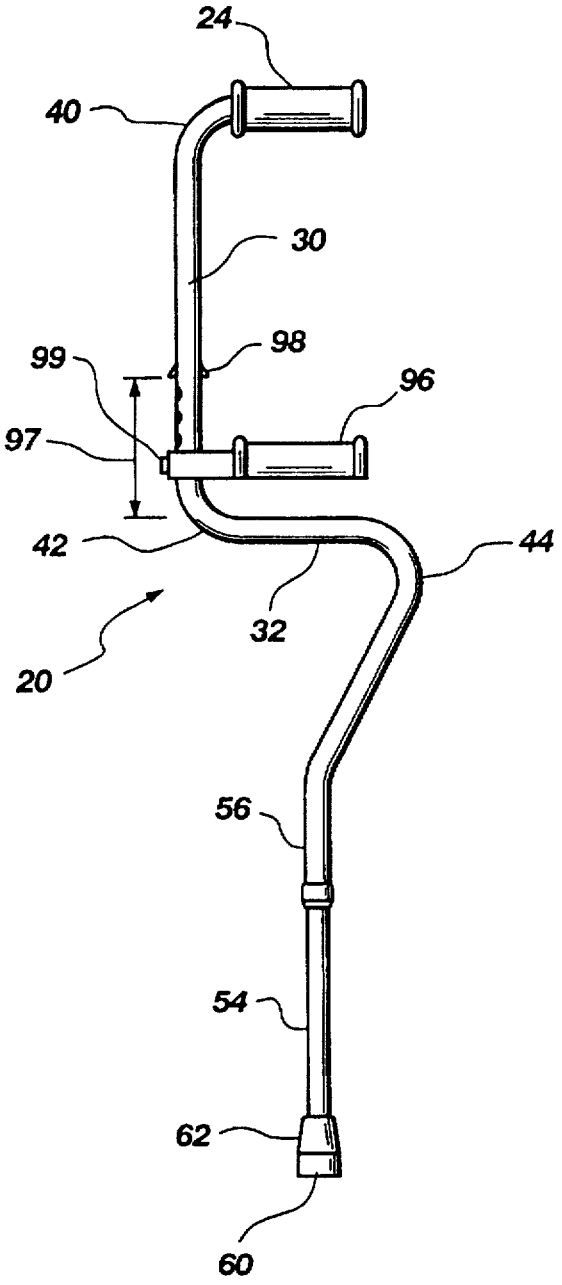
FIG. 6 is an alternative embodiment of a cane having a third, slidably adjustable handle.

In yet another embodiment of the cane 20 of the present invention, shown in FIG. 6, the cane 20 may be structured with a third handle 96 which is slidably positioned on the web member 30 so that it can be adjusted upwardly and downwardly along the web member 30. The third handle 96 may be slidably positionable a distance 97 defined between the second handle 32 and a stop 98 which prevents the third handle 96 being brought into so close a proximity to the first handle 24 that the user's arm is impeded when using the third handle 96 to rise from a seated position. Thus, the third handle 96 may be adjusted from a position adjacent the second handle 32 to a distance 97 of about six inches. The third handle 96 may be secured in place at a selected distance 97 from the second handle 32 by such means as a detent 99 or other suitable means.

It is to be understood that all of the unique cane embodiments described herein may be fitted with a tripod or quadrapod foot to create more stability for persons desiring such additional stability. The cane of the present invention is structured to provide some degree of shock absorbing characteristics to the cane, which is very desirable for people with arthritic wrists, elbows or shoulders.

The present invention may be manifest not only in a cane, but in the form of a walker 100, as illustrated in FIGS. 7–16. The walker 100 illustrated in FIG. 7 generally comprises a frame 102 structure having a three-dimensional profile for providing stabilizing support means to an ambulatory person. Thus, the frame 102 can be considered to have a first side portion 104 oriented to the right of a user, a second side portion 106 oriented to the left of a user and a forward portion 108 positioned in front of the user. The first side portion 104 is generally oriented in a plane parallel to the second side portion 106 and is spaced apart from the second side portion 106 a distance sufficient to permit the user to stand between the first side portion 104 and the second side portion 106. A spacing bar 109 may extend between the first side portion 104 and the second side portion 106 to maintain the spacing therebetween.

The frame 102 includes at least three stably positioned and spaced-apart legs, and preferably four legs 110, 112, 114, 116 as shown. The two legs 112, 116 of the first side portion 104 may be spaced apart and maintained in such spaced arrangement by a first side spacer bar 118, and the two legs 110, 114 of the second side portion 106 may be spaced apart and maintained in such spaced arrangement by a second side spacer bar 119. For the purposes of orientation, leg 116 of the first side portion 104 and leg 114 of the second side portion 106 may also be referred to herein as "the rear leg" of a given side portion. Accordingly, when reference is made to an element being "in front" of a rear leg, it is meant that the element is located in the direction of the forward portion 108 of the frame 102. When reference is made herein to "behind" or "to the rear of" the rear legs, it is meant that the element of reference point is oriented away from the rear legs 114, 116 in a direction opposite that of the forward portion 108.

A first handle 120 formed at the top 124 of the first side portion 104 and a first handle 122 formed at the top 124 of the second side portion 106 provide places where the user may grasp the walker 100 while in a standing and/or an ambulatory position. The first handles 120, 122 are spaced from the floor, or other support surface upon which the frame 102 is supported, a distance 128 sufficient to accommodate the height of various users. Since height differs among individuals, the legs 110, 112, 114, 116 of the walker 100 may be constructed with extendable shaft members 130, 132, 134, 136 which permit the height of the legs 110, 112, 114, 116 to be increased or decreased to suit the individual user (see also FIG. 10). The legs 110, 112, 114, 116 may preferably be fitted with ground-engaging tips 140, 142, 144, 146, such as rubber friction tips, at the lower extremity thereof to provide a degree of cushion to the frame 102 as downward force is applied by the user, and to prevent skidding of the legs 110, 112, 114, 116 on a slick surface. Although not shown, the walker 100 may be configured with rollers or wheels rather than ground-engaging tips 140, 142, 144, 146.

A second handle 150 is interconnected to the first handle 120 of the first side portion 104 by a web member 156, and a second handle 152 is interconnected to the first handle 122 of the second side portion 106 by a web member 158. The first handle 120 and second handle 150 of the first side portion 104 constitute a "pair of handles", and the first handle 122 and second handle 152 of the second side portion 106 constitute another "pair of handles." The second handles 150, 152 of each pair of handles are oriented below and vertically spaced apart from the first handles 120, 122 of each pair of handles. The distance 160 between the second handles 150, 152 and the floor, or a support surface, is sufficient to permit a user to grasp the second handles 150, 152 while in a sitting position and to push downwardly to gain leverage in rising to a standing position. The distance 160 between the second handles 150, 152 and the floor or support surface may vary, but generally a distance 160 of between sixteen inches and twenty-five inches positions the second handles 150, 152 at an appropriate height for rising from a seated position in any size or shape chair. Both the first handles 120, 122 and the second handles 150, 152 may include soft, pliant grips 164, 166, 168, 170 to facilitate a secure and comfortable grasping of the first handles 120, 122 and second handles 150, 152.

The web members 156, 158 extending between the first handles 120, 122 and the second handles 150, 152 are connected to the first handles 120, 122 by upper curved portions 172, 174, respectively, and are connected to the second handles 150, 152 by lower curved portions 176, 178, respectively. The second handles 150, 152 are further connected to legs 116, 114, respectively by side curved portions 180, 182, respectively. The unitary and continuous curvilinear configuration of the frame 102, from the first handles 120, 122 to the legs 116, 114, provides a very small degree of cushion to the walker 100 as the user pushes downwardly on the first handles 120, 122 or on the second handles 150, 154. The walker 100 is constructed to be substantially rigid and very stable to withstand the weight of any user forcing downwardly on the walker 100. However, the slight cushioning characteristic of the walker 100 of the present invention makes use of the walker 100 particularly advantageous for elderly or arthritic users.

Figure 7:
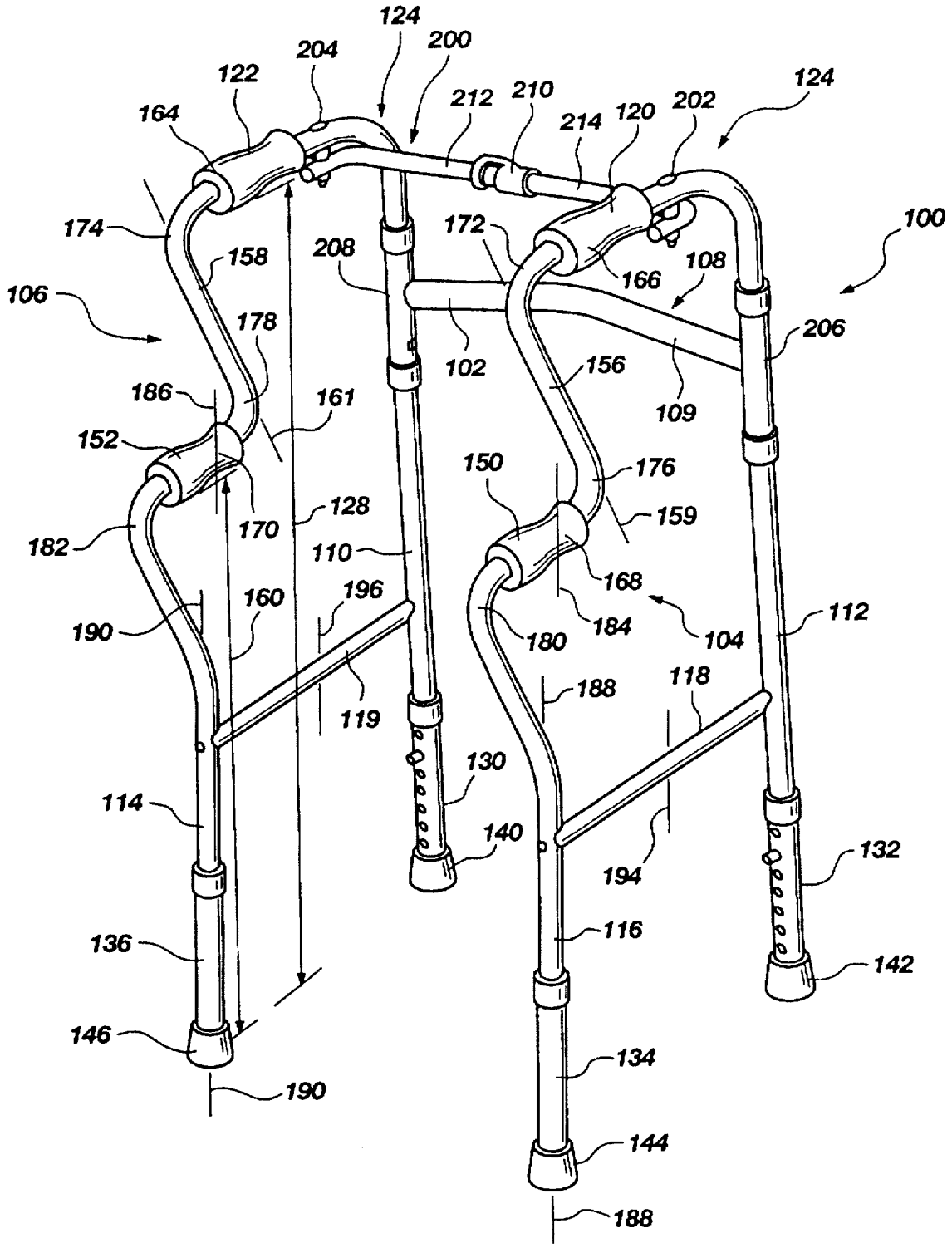
FIG. 7 is a perspective view of a walker embodiment of the present invention.
Figure 8:
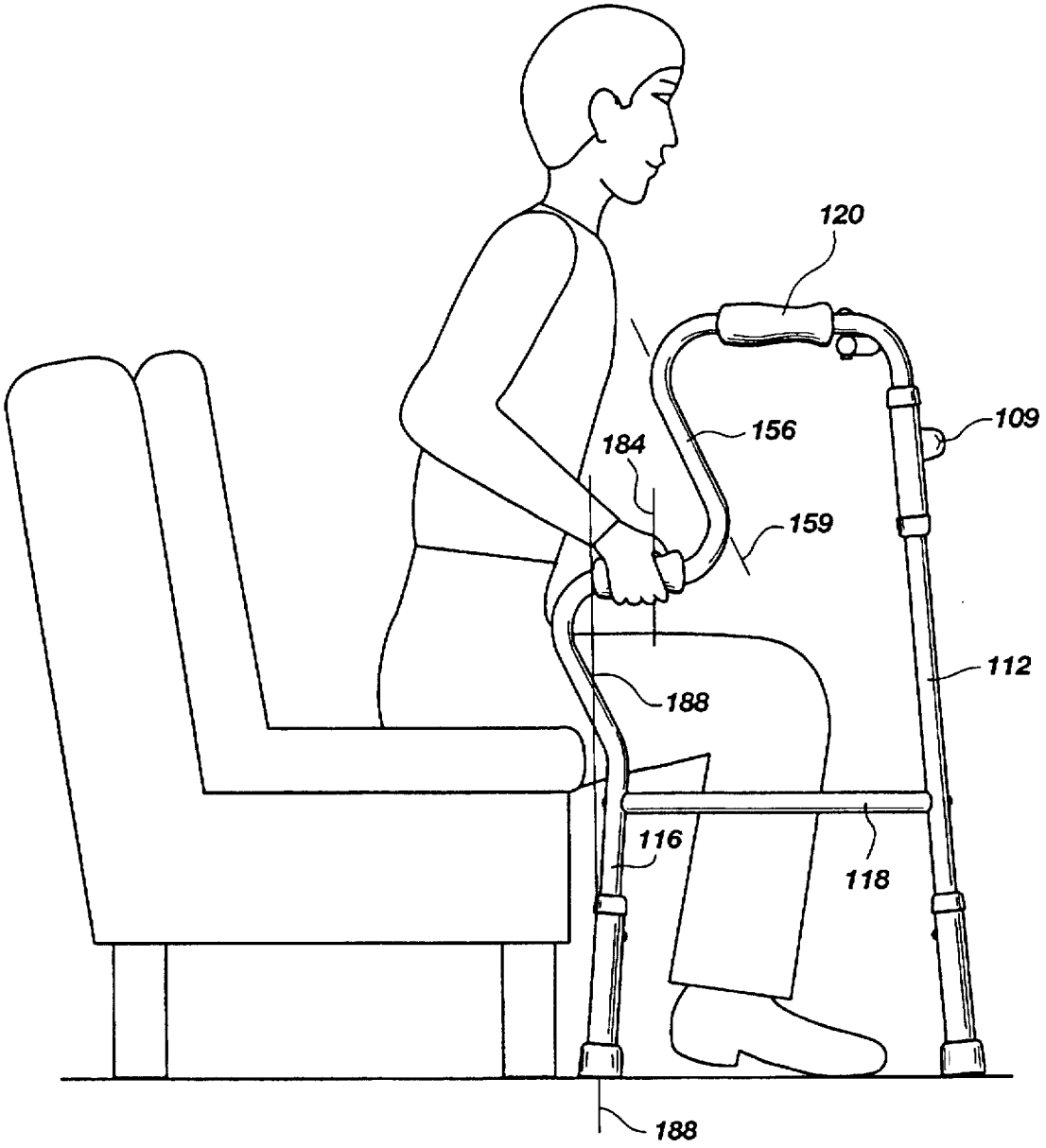
FIG. 8 is a side view in elevation illustrating the use of the walker shown in FIG. 7 to assist a user in rising from a seated position.

As illustrated in FIGS. 7 and 8, the walker 100 of the present invention is advantageously configured to position the geometric center 184, 186 of the second handles 150, 152 in front of the vertical longitudinal axis 188, 190 formed through the ground-engaging tips 144, 146 and rear legs 116, 114, respectively. In any embodiment of the walker 100 of the present invention, the geometric center 184, 186 of the second handles 150, 152 is positioned in front of the vertical longitudinal axis 188, 190 associated with the rear leg 116, 114. But the geometric center 184, 186 of the second handles 150, 152 can be positioned anywhere from directly in front of the vertical axis 188, 190, as suggested by FIG. 7, to about the mid-point vertical axis 194, 196 of the side portions 104, 106. If the geometric center 184, 186 of the second handle 150, 152 is positioned much farther forward than the mid-point vertical axis 194, 196 of the side portions 104, 106, the second handles 150, 152 are too far forward relative to the user to be of effective assistance in rising from a seated position because the second handles 150, 152 are too far away to be pushed down upon. In addition, the walker 100 may become unstable in the direction of the forward portion 108. The advantage of the present configuration can be seen when the user pushes downwardly on the second handles 150, 152 while in a seated position, as shown in FIG. 8. The force is transferred to the ground-engaging tips 144, 146 and the rear legs 116, 114, and the walker 100 is rendered stable during the uprisal of the user because the force is in front of the rear legs 114, 116.

Figure 9:
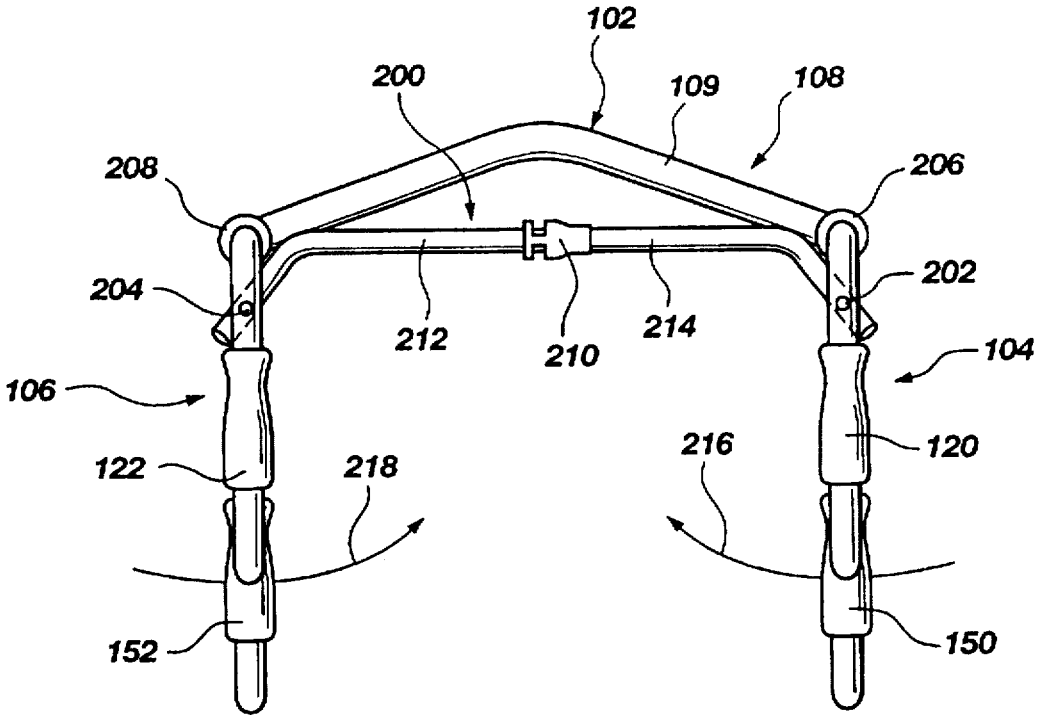
FIG. 9 is a plan view of the walker shown in FIG. 7 illustrating the collapsible feature of the invention.

The walker 100 may be configured with means for collapsing the walker 100 into a more two-dimensional profile for easier carrying or storage when not in use. One exemplar means for providing collapsibility to the walker 100 is shown in FIGS. 7 and 9 where a collapsible bar 200 may be positioned between the first side portion 104 and the second side portion 106, near the top 124, to further maintain the spacing between the first side portion 104 and the second side portion 106. The collapsible bar 200 may be pivotally connected to the first side portion 104 of the frame 102 at a point 202 proximate the first handle 122, and may be pivotally connected to the second side portion 106 of the frame 102 at a point 204 proximate the first handle 124 of the second side portion 106. Additionally, the first side portion 104 and second side portion 106 may both be rotatable relative to the spacing bar 109 by the front leg 112 being slidably received in a first sleeve member 206 (see also FIG. 10) and the front leg 110 of the second side portion 106 being slidably received in a second sleeve member 208, both the first sleeve member 206 and the second sleeve member 208 being connected to the spacing bar 109.

To collapse the walker 100, a securing latch 210 positioned on the collapsible bar 200 may be released which allows the first bar member 212 and second bar member 214 of the collapsible bar 200 to move relative to each, such as first bar member 212 being slidably telescoping within second bar member 214. The first side portion 104 of the frame 102 pivots with respect to the collapsible bar 200 at point 202, in the direction of arrow 216, and the second side portion 106 of the frame 102 pivots with respect to the collapsible bar 200 at point 204, in the direction of arrow 218. At the same time, the front leg 112 of the first side portion 104 rotates within first sleeve member 206 and the front leg 110 of the second side portion 106 rotates within second sleeve member 208 so that the first side portion 104 and the second side portion 106 come to rest in substantially parallel alignment with the front portion 108 of the frame 102. Other mechanisms for collapsing the walker 100 may be employed.

Figure 11:
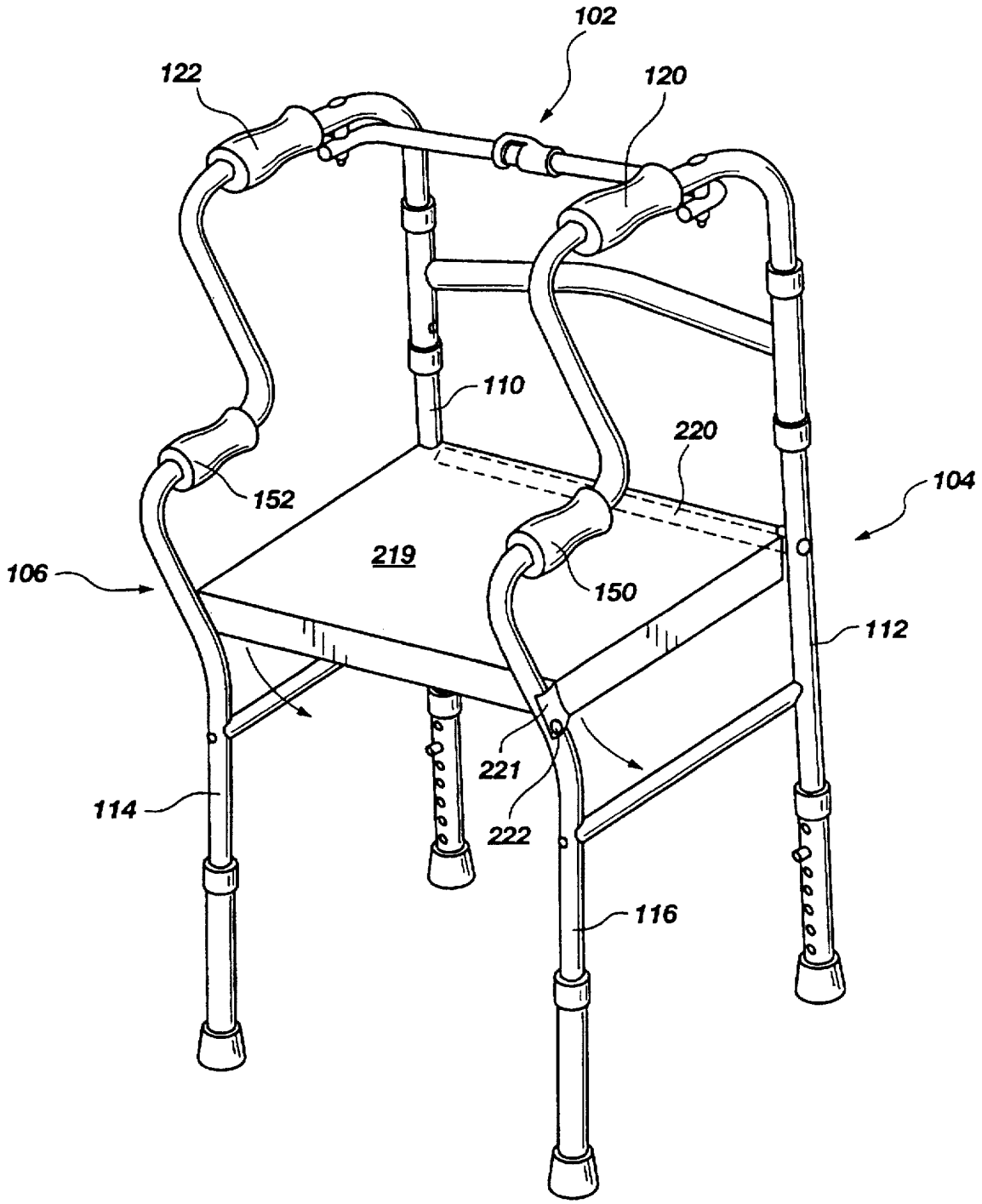
FIG. 11 is a view in perspective of the walker embodiment shown in FIG. 7 having a movable seat.

FIG. 11 illustrates another optional element of the walker 100 where a movable seat 219 is pivotally connected by a stabilizing bar member 220 (shown in phantom) between the front leg 112 of the first side portion 104 and the front leg 110 of the second side portion 106. The seat 219 may have reinforced bracket members 221 positioned toward the front of the seat 219 which engage and rest upon a support peg 222 secured to the rear legs 114, 116 of the frame 102. When not in use, the reinforced bracket members 221 may be disengaged from the support pegs 222 and the seat 219 allowed to swing in the direction of the arrows to reside flat against and between front legs 110, 112. The first side portion 104 and second side portion 106 may then be collapsed as previously described to reduce the walker 100 to a two-dimensional profile.

Figure 10:
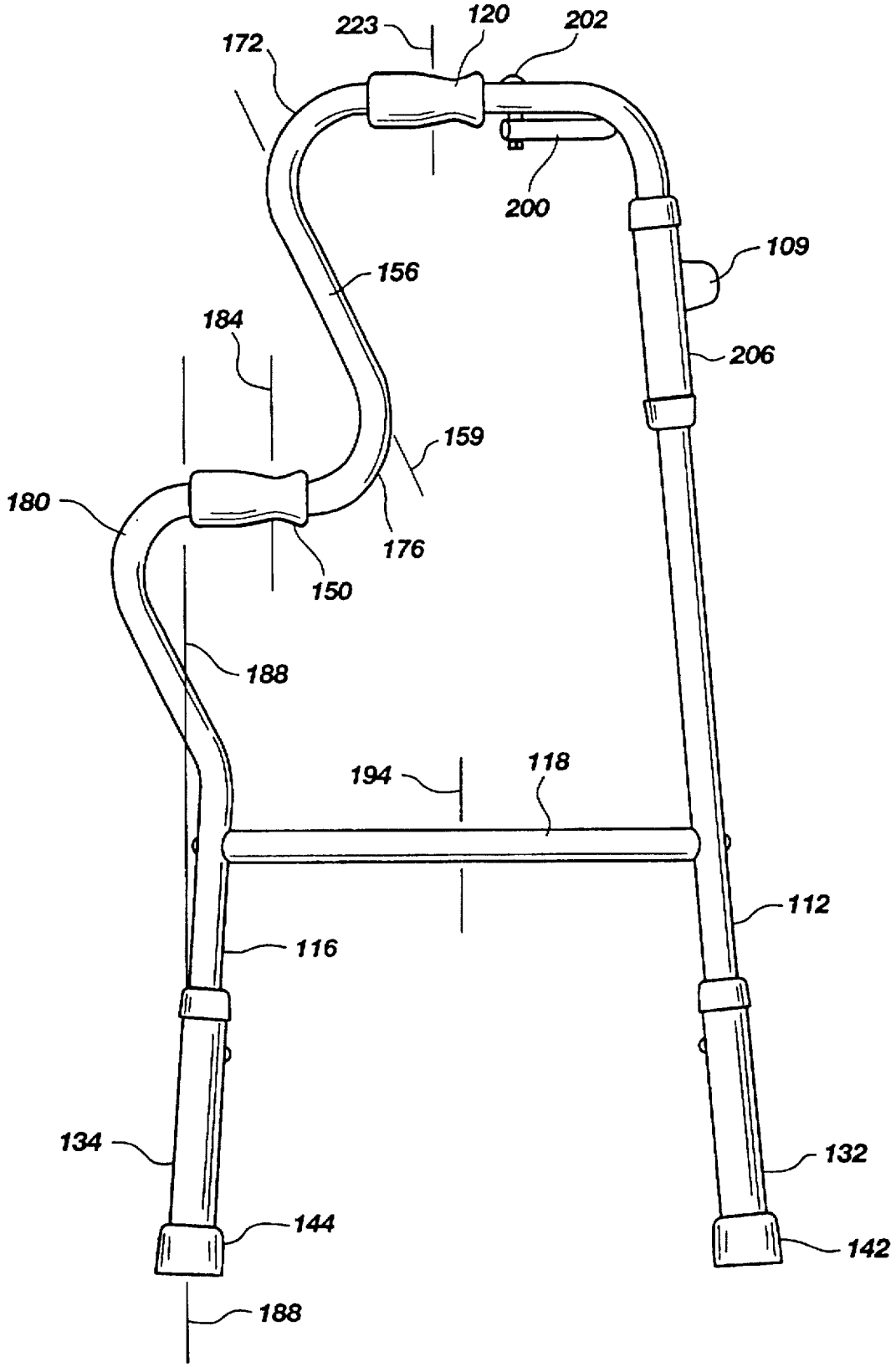
FIG. 10 is a side view in elevation of the embodiment of the walker shown in FIG. 7.

The walker 100 embodiment illustrated in FIGS. 7 and 10 is configured with web members 156, 158, positioned between the first handles 120, 122 and the second handles 150, 152, each having a longitudinal axis 159, 161 which is positioned at an angle to the substantially vertical longitudinal axis 188, 190 associated with each of the rear legs 116, 114 of the frame 102. Thus, the upper curved portion 172, 174 between the first handles 120, 122 and the web members 156, 158, and the lower curved portion 176, 178 between the web members 156, 158 and the second handles 150, 152 have an acute inside angle of curvature (i.e., less than 90°).

Figure 12:
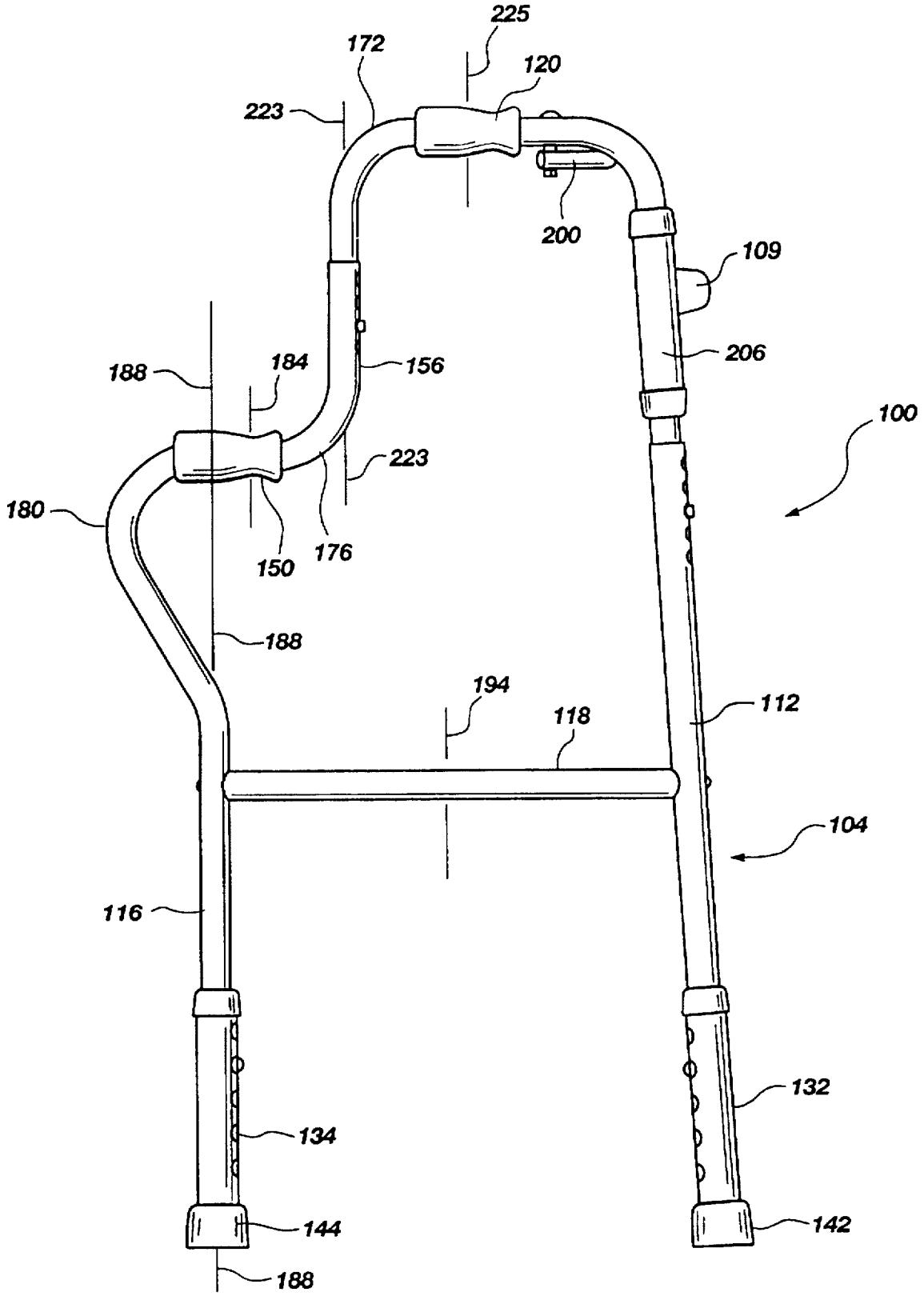
FIG. 12 is a side view in elevation of an alternative walker embodiment of the present invention.

An alternative embodiment of the walker 100 is illustrated in FIG. 12 where only the first side portion 104 is shown and described, but it is understood that the elements of construction and configuration described are equally applicable to the second side portion 106 not shown. In the alternative embodiment of the walker 100 shown in FIG. 12, the inside angle of curvature of the upper curved portion 172 and the inside angle of curvature of the lower curved portion 176 is relatively larger (i.e., approximately 90°) than the embodiment illustrated in FIGS. 7 and 10. Therefore, the web member 156 is considerably more vertical in orientation and has a longitudinal axis 223 associated therewith which is substantially in parallel alignment with the longitudinal axis 188 positioned through the rear leg 116.

In the alternative embodiment illustrated in FIG. 12, the geometrical center 184 of the second handle 150 is positioned in front of longitudinal axis 188 of the rear leg 116 so that the imposition of weight on the second handle 150 is transferred to a point in front of the load-bearing leg 116. The geometric center 223 of the first handle 120 in this embodiment may be situated substantially over the midpoint vertical axis 194 of the side portion 104.

Figure 13:
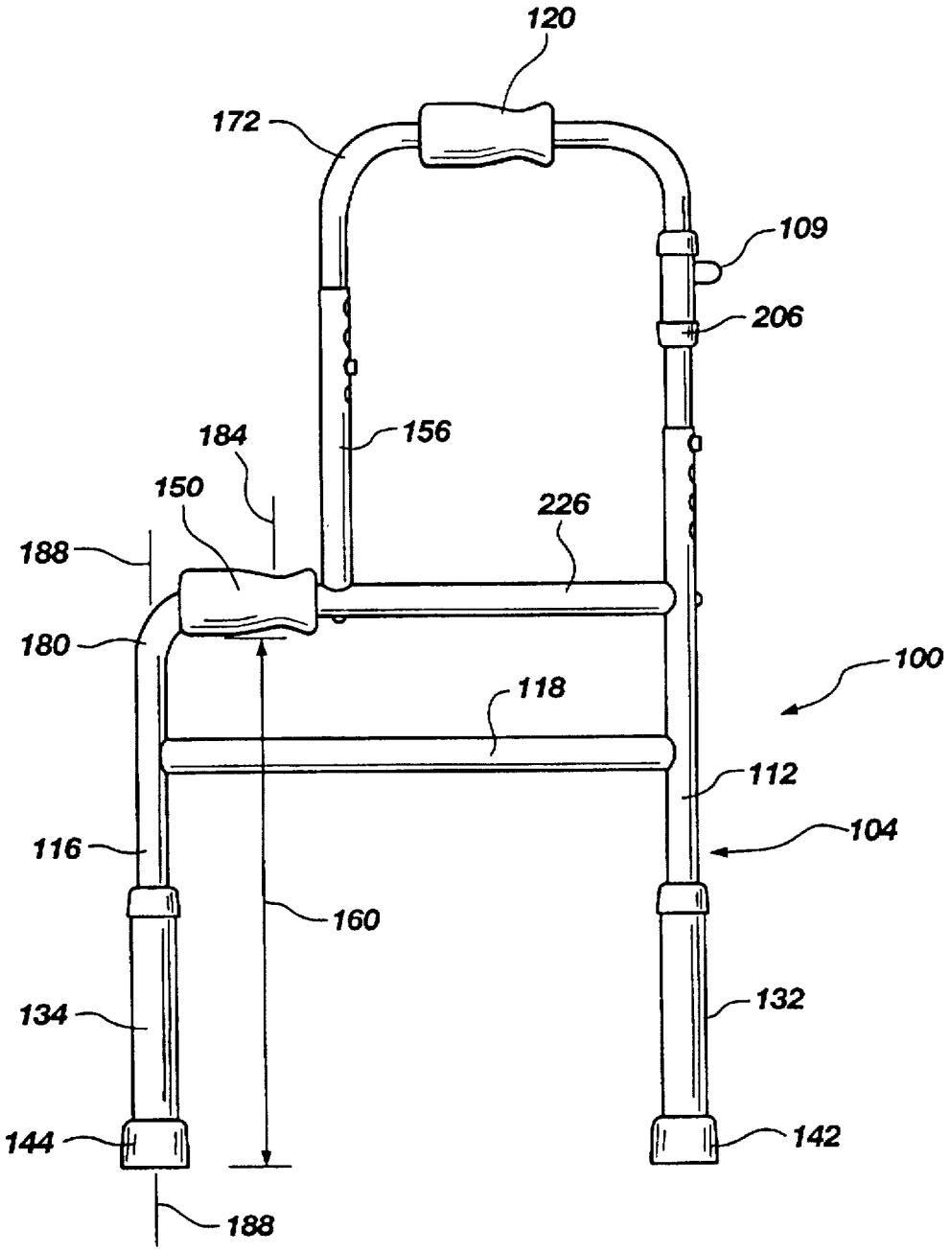
FIG. 13 is a side view in elevation of yet another alternative walker embodiment of the present invention.

Another alternative embodiment of the walker 100 of the present invention is illustrated in FIG. 13 where only the first side portion 104 is shown and described, but it is understood that the elements of construction and configuration described are equally applicable to the second side portion 106 not shown. In the walker 100 shown in FIG. 13, the second handle 150 is formed to the rear leg 116 by side curved portion 180 which has an inside angle of curvature of about 90°. The second handle 150 is also interconnected to the front leg 112 of the first side portion 104 by a support bar 226 which is secured to the front leg 112. The first handle 120 is formed to the web member 156 by an upper curved portion 172 which has an inside angle of curvature of about 90°, plus or minus 20°.

The web member 156 is secured to the support bar 226. The distance 160 between the second handle 150 and the floor is selected to position the second handle 150 at an appropriate height to assist a user in rising from a seated position. Although it may vary, a distance 160 of between about sixteen inches and about twenty-five inches positions the second handle 150 at a suitable height for arising from a seated position on most chairs, couches, benches, etc. The positioning of the second handle 150 above the rear leg 116 allows the transfer of weight imposed on the second handle 152 to a point in front of the rear leg 116 during uprisal.

Figure 14:
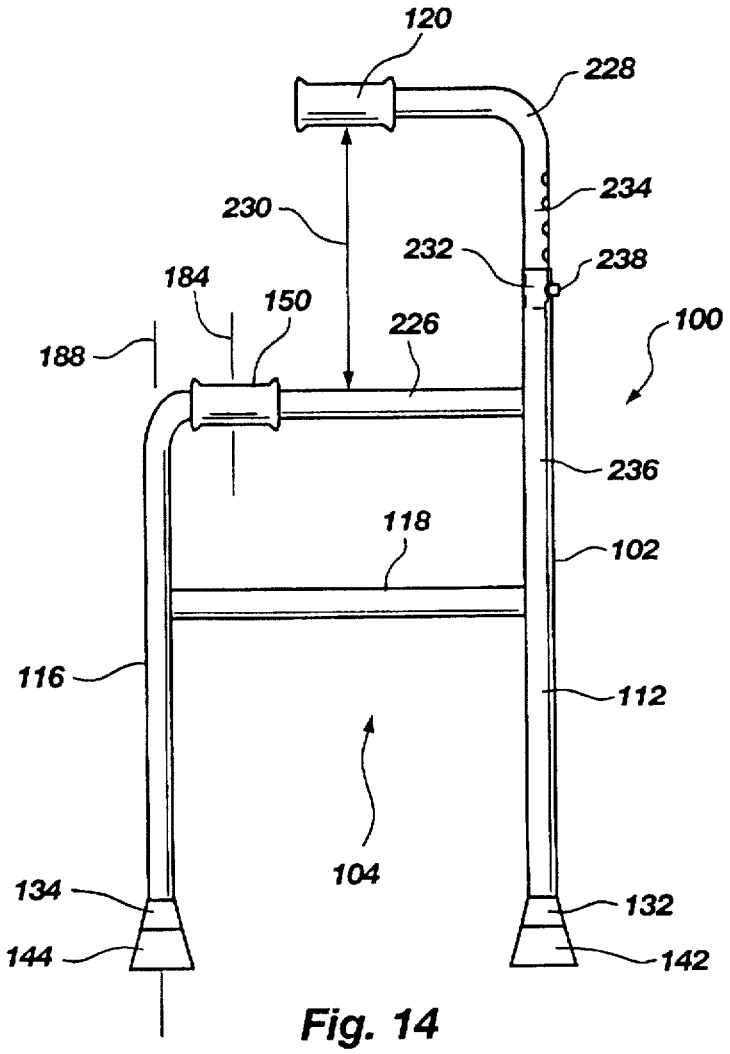
FIG. 14 is a side view in elevation of another alternative walker embodiment of the present invention.

Yet another alternative embodiment of the walker 100 of the present invention in shown in FIG. 14 where, again, only the first side portion 104 is shown and described, but it is understood that the elements of construction and configuration described are equally applicable to the second side portion 106 not shown. The illustrated embodiment of FIG. 14 differs from the previously described embodiments of the walker 100 in having the first handle 120 free and unattached to the second handle 150 by a web member. Rather, the first handle 120 is connected to the front leg 112 of the first side portion 104 by a front curved portion 228. The second handle 150 is also connected to the front leg 112 by support bar 226 and is connected to the rear leg 116. The front curved portion 228 of the frame may have an inside angle of curvature of between about 45° to about 135°. The distance 230 between the first handle 120 and the second handle 150 is sufficient to avoid the user's arm coming in contact with the first handle 120 during uprisal when the user's hand is positioned on the second handle 150. The distance 230 may preferably be between about ten inches and about sixteen inches. Also as illustrated in FIG. 14, space adjustment means 232 may be provided to selectively adjust the distance 230 between the first handle 120 and the second handle 150. One such adjustment means 232 may be, for example, configuring the upper leg portion 234 adjacent the front curved portion 228 to be slidably received within the lower leg portion 236 of leg 112, and to be maintained by means such as a detent 238. Other adjustment means 232 may be employed with equal efficiency.

Figure 15:
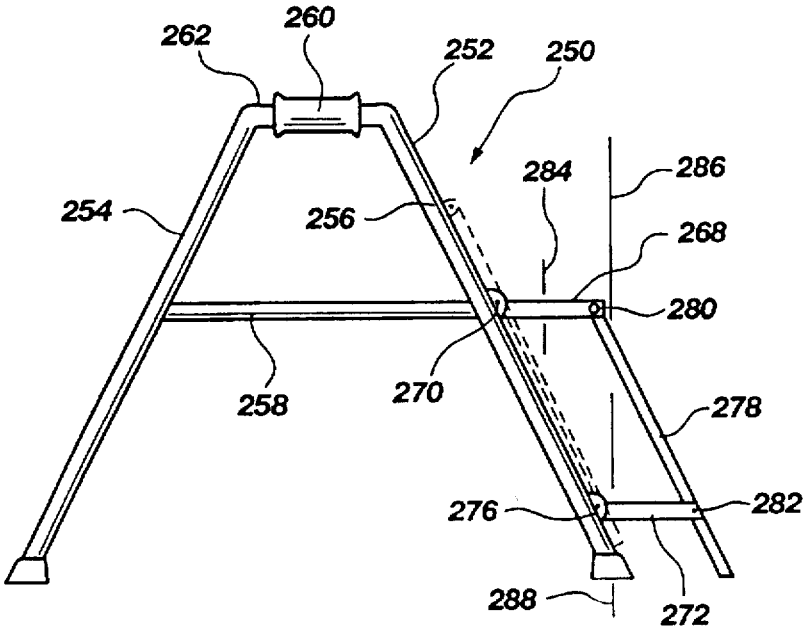
FIG. 15 is a side view in elevation of an alternative walker embodiment having a collapsible second handle.

Another embodiment of the present invention is illustrated in FIG. 15 where the walker 250 is shown in a side view with only a single side displayed. It is understood that the description provided herein with respect to the single side illustrated is equally applicable to the side which is not shown. The frame 252 is constructed with a front leg 254 and a back leg 256 with a support brace 258 therebetween. A first handle 260 is positioned at the top 262 of the frame 252, and is positioned between the front leg 254 and the rear leg 256. A second handle 268 is pivotally connected to the rear leg 256 by at least one pivot point 270. The second handle 268 may be aligned with a lateral support member 272 which is also pivotally connected to the rear leg 256 by a pivot means 276. The second handle 268 is also connected to the lateral support member 272 by a connector rod 278 which is secured to the second handle 268 by pivot means 280 and which is also secured to the lateral support member 272 by pivot means 282. When not in use, the second handle 268 pivots at 270 and 280, and the lateral support member 272 pivots at 276 and 282 to fold against the rear leg 256 as shown in phantom.

The second handle 268 of the embodiment shown in FIG. 15 has its geometric center 284 positioned in parallel alignment with, but in front of, the vertical axis 286 extending through the ground-engaging tip 288 of the rear leg 256. Thus, when the user pushes down on the second handles 268 (bearing in mind that the frame 252 has two rear legs and a second handle 268 pivotally connected to each), the second handles 268 fully support the user in uprisal (as well as in sitting down) without the frame tipping back on the user. The second handles 268 can then be folded up against the rear legs 256, as shown in phantom. Notably, the walker 100 embodiment shown in FIG. 15 may comprise only a second handle 268 pivotally joined to the rear leg 256 (i.e., without the lateral support member 272 and the connector rod 278) which is movable from a first position in parallel alignment with the rear leg 256 (as shown in phantom) to a second position where the second handle 268 has a lateral aspect relative to the frame 252.

Figure 16:
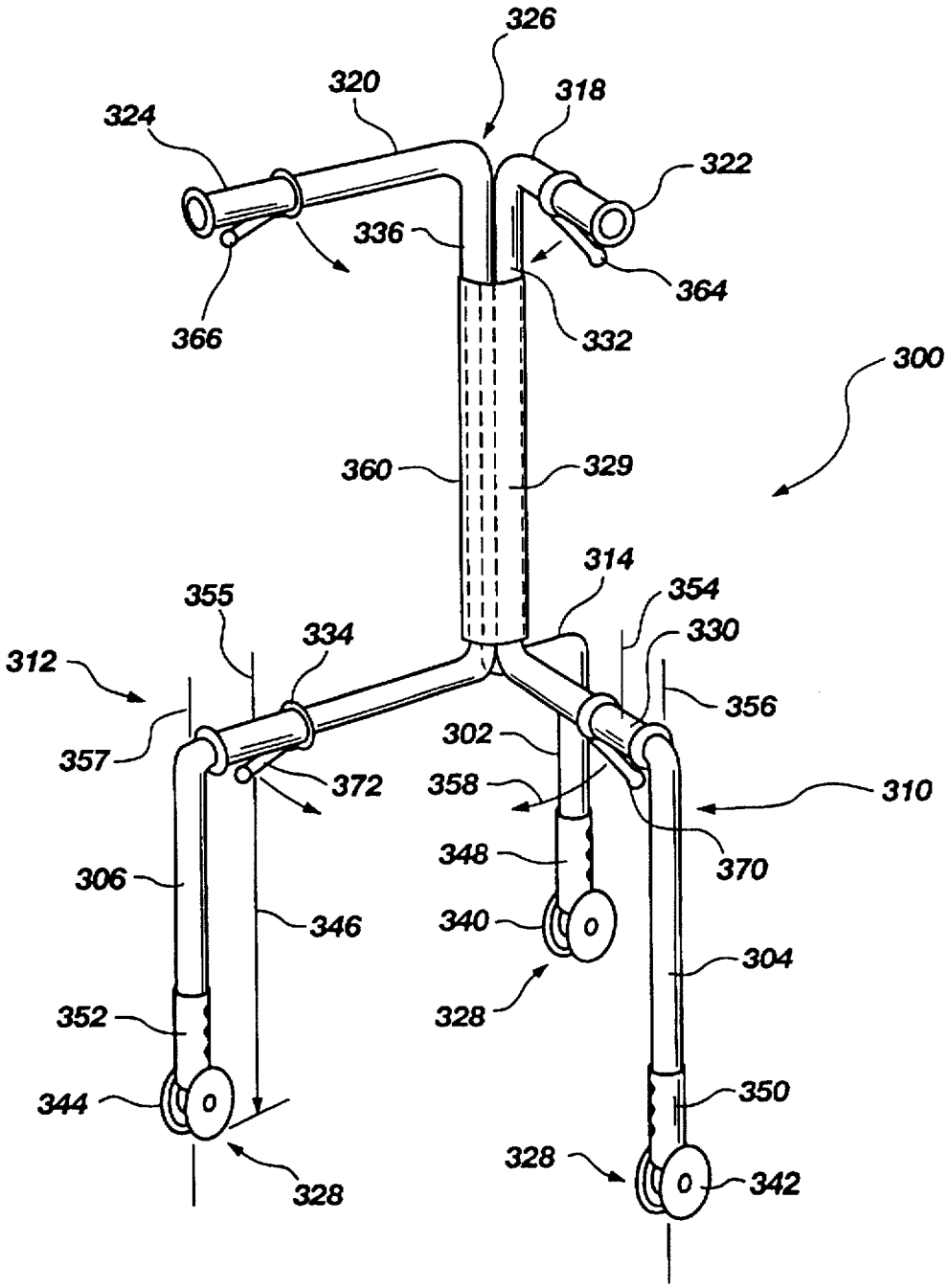
FIG. 16 is a view in perspective of an alternative walker embodiment having three legs.

Another alternative embodiment of the present invention is shown in FIG. 16 where the walker 300 is configured with three legs 302, 304, 306 which are spaced apart from each other to stably support a user in either a standing, ambulatory position or during uprisal from a seated position. The walker 300 may be considered to have a first side portion 310 positionable on the right side of the user and a second side portion 312 positionable on the left side of the user and a front leg support 314. Both the first side portion 310 and the second side portion 312 are constructed of a continuous, curvilinear structural member 318, 320 which has a first handle 322, 324 formed at the top 326 of the continuous, curvilinear structural member 318, 320, respectively, and which terminates at the distal end 328 with a load-bearing leg 304, 306, respectively. Notably, the front leg support 314 may comprise only a web member 329 (shown in phantom) which terminates in leg 302.

The first side portion 310 has a second handle 330 vertically spaced apart from, and positioned below, the first handle 322, and is joined to the first handle 322 by a web member 332 (shown in partial phantom). Likewise, the second side portion 312 has a second handle 334 vertically spaced apart from, and positioned below, the first handle 324, and is joined to the first handle 324 by a web member 336 (shown in partial phantom). The first handle 322 and second handle 330 of the first side portion form a "pair of handles," and the first handle 324 and second handle 334 of the second side portion 312 form another "pair of handles." The first handle 322, 324 of each pair are spaced from the second handle 330, 334 of each pair a distance sufficient to permit the user to use the second handles 330, 334 for uprisal without being obstructed by the first handles 322, 324. The distance between the first handle 322, 324 and second handle 330, 334 of each pair may be between about ten inches and about sixteen inches.

Each of the three legs 302, 304, 306 terminates in a ground-engaging means 340, 342, 344 which may be either wheels or coasters, as illustrated in FIG. 16, or rubber friction tips. The distance 346 between the second handles 330, 334 and the ground-engaging means 342, 344 of the legs 304, 306 to which the second handles 330, 334 are formed is selected to be a height sufficient to allow the user to grasp the second handles 330, 334 and push himself or herself up from a seated position, or to grasp the second handles 330, 334 and ease himself or herself into a seated position. The distance 346 may be between about seventeen to about twenty-five inches. The distance 346 may be selectively adjusted by length extension means 348, 350, 352 associated with each leg 302, 304, 306, respectively.

As with the other walker embodiments described previously, the geometric center 354, 355 of each of the second handles 330, 334 is positioned in front of the longitudinal axis 356, 357 which is formed through the leg 304, 306, respectively, to which the second handle 330, 334 is formed. Thus, by its design, the walker 300 may be used for rising from or lowing to a seated position without having the walker 300 become unstable.

The walker 300 embodiment illustrated in FIG. 16 may also be collapsible from a three-dimensional profile, as shown, to a two dimensional profile by rotating the first side portion 310 horizontally, in the direction of arrow 358, to bring the first side portion 310 in adjacent alignment with the second side portion 312. To facilitate the rotation of the first side portion 310 in relationship to the second side portion 312, a sleeve member 360 may be positioned about the web member 329 of the front leg portion 314, the web member 332 of the first side portion 310 and the web member 336 of the second side portion 312 to maintain those elements in adjacent proximity to each other, and to facilitate rotation of the web members 332, 336 relative to each other. The walker 300 may even be configured with adjustable means (not shown) which allow the first side portion 310 and second side portion 312 to be adjusted to any desired angular relationship relative to each other. In addition, by its collapsible construction, the walker 300 may be collapsed to a two-dimensional profile and used as a two-legged cane.

Optionally, the walker 300 may also be constructed with brake means 364, 366 associated with the first handle 322, 324 of each pair of handles when the walker 300 is configured with wheels or coasters 342, 344 at the terminal ends of the legs 304, 306. Additionally, the second handle 330, 334 of each pair of handles may be constructed with brake means 370, 372 to prevent the walker 300 from moving when the user is rising from a seated position with the assistance of the second handles 330, 334.

The walking- and uprisal assist devices of the present invention provide a unique, dual handled configuration which permit the user to employ one handle or set of handles to arise from a seated position and another handle or set of handles to assist in walking. While being suitably rigid in construction, the continuous curvilinear configuration of the present invention provides a degree of cushioning in the invention which makes use of the device for uprisal and walking more suitable for elderly and arthritic users as compared to devices previously known and used. The spacing between the handles also provides unobstructed use of the device for uprisal and is particularly suitable for elderly and arthritic users. The present invention can be adapted for use in the form of either a cane or a walker, or any other suitable walking-assist device. Thus, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. A rigid walking- and uprisal-assist device comprising:

a structural frame having a three-dimensional profile, a forward portion and at least three legs, each said at least three legs having a ground-engaging surface for positioning on a support surface;

a first side portion formed by said frame having an upper graspable handle for supporting a user in a standing position and a lower graspable handle vertically spaced apart from and positioned below said upper handle and horizontally spaced apart from said upper handle to render said lower handle unobstructed by the upper handle, said lower handle being connected to one of said at least three legs of said frame and being positioned in elevation above said ground-engaging surface of said one leg to facilitate uprisal of a user from a seated position, and said lower handle having its geometrical center positioned in alignment with and forward of a longitudinal axis formed through said one leg and ground-engaging surface of said one leg; and a second side portion formed by said frame having an upper graspable handle for supporting a user in a standing position and a lower graspable handle vertically spaced apart from and positioned below said upper handle and horizontally spaced apart from said upper handle to render said lower handle unobstructed by the upper handle, said lower handle being connected to another of said at least three legs of said frame and being positioned in elevation above said ground-engaging surface of said another leg to facilitate uprisal of a user from a seated position, and said lower handle of said second side portion having its geometrical center positioned in alignment with and forward of a longitudinal axis formed through said another leg and ground-engaging surface of said another leg.

2. The rigid walking- and uprisal-assist device of claim 1 wherein said upper handle and said lower handle of said first side portion are joined by a first web member, and wherein said upper handle and said lower handle of said second side portion are joined by a second web member.

3. The rigid walking- and uprisal-assist device of claim 2 wherein said first web member is continuously formed to said upper handle and is continuously formed to said lower handle of said first side portion, and wherein said second web member is continuously formed to said upper handle and is continuously formed to said lower handle of said second side portion.

4. The rigid walking- and uprisal-assist device of claim 3 wherein said first web member and said second web member each have a longitudinal axis formed therethrough, said longitudinal axis of said first web member being oriented at an angle to a vertical axis formed through said leg associated with said first side portion, and said longitudinal axis of second web member being oriented at an angle to a vertical axis formed through said leg associated with said second side portion.

5. The rigid walking- and uprisal-assist device of claim 4 wherein said first side portion is configured with two spaced apart legs, and said second side portion is configured with two spaced apart legs, and wherein each said leg of said first side portion and each leg of said second side portion is adjustable in length to selectively position said lower handle of said first side portion and said lower handle of said second side portion a selected distance from said ground-engaging surface associated with each said leg.

6. The rigid walking- and uprisal-assist device of claim 5 wherein said distance between said lower handle of said first side portion and said ground-engaging surface and the distance between said lower handle of said second side portion and said ground-engaging surface is between about sixteen inches to about twenty-five inches.

7. The rigid walking- and uprisal-assist device of claim 5 wherein the distance between said upper handle and said lower handle of said first side portion and the distance between said upper handle and said lower handle of said second side portion is selectively adjustable.

8. The rigid walking- and uprisal-assist device of claim 7 wherein said distance between said upper handle and said lower handle of said first side portion and the distance between said upper handle and said lower handle of said second side portion ranges between about ten inches to about sixteen inches.

9. The rigid walking- and uprisal-assist device of claim 5 further comprising collapsible means for modifying said structural frame from a three-dimensional profile to a substantially two-dimensional profile.

10. The rigid walking- and uprisal-assist device of claim 9 further comprising a movable seat interconnected between said first side portion and said second side portion, said movable seat being positionable from a first, collapsed position adjacent two of said legs of the frame to a second, engaged position oriented in a horizontal plane relative to each said leg of said frame.

11. The rigid walking- and uprisal-assist device of claim 3 wherein said first web member and said second web member each have a longitudinal axis formed therethrough, each said longitudinal axis formed through said first web member and through said second web member being substantially vertical in orientation.

12. The rigid walling- and uprisal-assist device of claim 11 wherein said first side portion is configured with two spaced apart legs, and said second side portion is configured with two spaced apart legs, and wherein each said leg of said first side portion and each leg of said second side portion is adjustable in length to selectively position said lower handle of said first side portion and said lower handle of said second side portion a selected distance from the ground.

13. The rigid walking- and uprisal-assist device of claim 12 wherein said distance between said lower handle of said first side portion and said ground and the distance between said lower handle of said second side portion and said ground is between about sixteen inches to about twenty-five inches.

14. The rigid walking- and uprisal-assist device of claim 12 wherein the distance between said upper handle and said lower handle of said first side portion and the distance between said upper handle and said lower handle of said second side portion is selectively adjustable.

15. The rigid walking- and uprisal-assist device of claim 14 wherein said distance between said upper handle and said lower handle of said first side portion and the distance between said upper handle and said lower handle of said second side portion ranges between about ten inches to about sixteen inches.

16. The rigid walking- and uprisal-assist device of claim 12 further comprising collapsible means for modifying said structural frame from a three-dimensional profile to a substantially two-dimensional profile.

17. The rigid walking- and uprisal-assist device of claim 16 further comprising a movable seat interconnected between said first side portion and said second side portion, said movable seat being positionable from a first, collapsed position adjacent two of said legs of the frame to a second, engaged position oriented in a horizontal plane relative to each said leg of said frame.

18. The rigid walking- and uprisal-assist device of claim 1 wherein said upper handle and said lower handle of said first side portion are joined by a first discontinuous web member, and wherein said upper handle and said lower handle of said second side portion are joined by a second discontinuous web member.

19. The rigid walking- and uprisal-assist device of claim 18 wherein said first side portion is configured with two spaced apart legs, and said second side portion is configured with two spaced apart legs, and wherein each said leg of said first side portion and each leg of said second side portion is adjustable in length to selectively position said lower handle of said first side portion and said lower handle of said second side portion a selected distance from the ground.

20. The rigid walking- and uprisal-assist device of claim 19 wherein said distance between said lower handle of said first side portion and said ground and the distance between said lower handle of said second side portion and said ground is between about sixteen inches to about twenty-five inches.

21. The rigid walking- and uprisal-assist device of claim 19 wherein the distance between said upper handle and said lower handle of said first side portion and the distance between said upper handle and said lower handle of said second side portion is selectively adjustable.

22. The rigid walking- and uprisal-assist device of claim 21 wherein said distance between said upper handle and said lower handle of said first side portion and the distance between said upper handle and said lower handle of said second side portion ranges between about ten inches to about sixteen inches.

23. The rigid walking- and uprisal-assist device of claim 19 further comprising collapsible means for modifying said structural frame from a three-dimensional profile to a substantially two-dimensional profile.

24. The rigid walling- and uprisal-assist device of claim 23 further comprising a movable seat interconnected between said first side portion and said second side portion, said movable seat being positionable from a first, collapsed position adjacent two of said legs of the frame to a second, engaged position oriented in a horizontal plane relative to each said leg of said frame.

25. The rigid walking- and uprisal-assist device of claim 1 wherein said upper handle of said first side portion is spaced apart from and suspended over said lower handle of said first side portion, and wherein said upper handle of said second side is spaced apart from and suspended over said lower handle of said second side portion.

26. The rigid walking- and uprisal-assist device of claim 25 wherein said first side portion is configured with two spaced apart legs, and said second side portion is configured with two spaced apart legs, and wherein each said leg of said first side portion and each leg of said second side portion is adjustable in length to selectively position said lower handle of said first side portion and said lower handle of said second side portion a selected distance from the ground.

27. The rigid walking- and uprisal-assist device of claim 26 wherein said distance between said lower handle of said first side portion and said ground and the distance between said lower handle of said second side portion and said ground is between about sixteen inches to about twenty-five inches.

28. The rigid walking- and uprisal-assist device of claim 26 wherein the distance between said upper handle and said lower handle of said first side portion and the distance between said upper handle and said lower handle of said second side portion is selectively adjustable.

29. The rigid walking- and uprisal-assist device of claim 28 wherein said distance between said upper handle and said lower handle of said first side portion and the distance between said upper handle and said lower handle of said second side portion ranges between about ten inches to about sixteen inches.

30. The rigid walking- and uprisal-assist device of claim 26 further comprising collapsible means for modifying said structural frame from a three-dimensional profile to a substantially two-dimensional profile.

31. The rigid walking- and uprisal-assist device of claim 30 further comprising a movable seat interconnected between said first side portion and said second side portion, said movable seat being positionable from a first, collapsed position adjacent two of said legs of the frame to a second, engaged position oriented in a horizontal plane relative to each said leg of said frame.

32. The rigid walking- and uprisal-assist device of claim 1 wherein said lower handle of said first side portion is rotatably connected to said one of said at least three legs of said frame such that said lower handle is positionable from a first position against and in substantial parallel alignment with said leg to a second position having a lateral aspect relative to said leg, and wherein said lower handle of said second side portion is rotatably connected to said another of said at least three legs of said frame such that said lower handle of said second side portion is positionable from a first position against and in substantial parallel alignment with said leg to a second position having a lateral aspect relative to said leg.

33. The rigid walking- and uprisal-assist device of claim 1 wherein said structural frame has three legs, one said leg being formed with said first side portion and another said leg being formed with said second side portion, and a third said leg being formed as said forward portion of said frame.

34. The rigid walking- and uprisal-assist device of claim 33 wherein each of said three legs is selectively adjustable in length.

35. The rigid walking- and uprisal-assist device of claim 34 wherein said first side portion and said second side portion are rotatable about a vertical axis relative to each other to collapse said frame structure from a three-dimensional profile to a two-dimensional profile.

36. The rigid walking- and uprisal-assist device of claim 35 wherein each of said three legs has a friction tip at a distal end thereof to provide said ground-engaging surface.

37. The rigid walking- and uprisal-assist device of claim 35 wherein each of said three legs has a wheel means formed at a distal end thereof to provide said ground-engaging surface.

38. The rigid walking- and uprisal-assist device of claim 37 wherein said upper handle and said lower handle of said first side portion each have a hand brake associated therewith in mechanical communication with said wheel means connected to said distal end of said leg of said first side portion, and wherein said upper handle and said lower handle of said second side portion each have a hand brake associated therewith in mechanical communication with said wheel means connected to said distal end of said leg of said second side portion.

* * * * *